US006255914B1

(12) United States Patent
Ishikawa et al.

(10) Patent No.: US 6,255,914 B1
(45) **Date of Patent: *Jul. 3, 2001**

(54) TM MODE DIELECTRIC RESONATOR AND TM MODE DIELECTRIC FILTER AND DUPLEXER USING THE RESONATOR

(75) Inventors: Yohei Ishikawa, Kyoto; Seiji Hidaka, Nagaokakyo; Norifumi Matsui, Kyoto; Tomoyuki Ise, Nagaokakyo; Kazuhiko Kubota, Muko, all of (JP)

(73) Assignee: Murata Manufacturing Co., Ltd. (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/505,633

(22) Filed: Feb. 16, 2000

Related U.S. Application Data

(62) Division of application No. 08/924,040, filed on Aug. 29, 1997, now Pat. No. 6,052,041.

(30) Foreign Application Priority Data

Aug. 29, 1996 (JP) ..... 8-228792

(51) Int. Cl.[7] ..... H01P 1/213; H01P 1/201; H01P 7/10

(52) U.S. Cl. ..... 333/134; 333/202; 333/219.1

(58) Field of Search ..... 333/134, 202, 333/219.1

(56) References Cited

U.S. PATENT DOCUMENTS

| | | | | |
|---|---|---|---|---|
| 2,890,422 | * | 6/1959 | Schlicke | 333/219.1 |
| 4,706,052 | * | 11/1987 | Hattori et al. | 333/219.1 |
| 4,727,342 | * | 2/1988 | Ishikawa et al. | 333/219.1 |
| 5,920,244 | * | 7/1999 | Kobayashi et al. | 333/219.1 X |
| 6,016,091 | * | 1/2000 | Hidaka et al. | 333/219.1 X |
| 6,052,041 | * | 4/2000 | Ishikawa et al. | 333/202 |

FOREIGN PATENT DOCUMENTS

| | | | |
|---|---|---|---|
| 0786822 | | 7/1977 | (EP) . |
| 0336675 | | 10/1989 | (EP) . |
| 0716468 | | 6/1996 | (EP) . |
| 63-266903 | * | 11/1988 | (JP) . |
| 2-52501 | * | 2/1990 | (JP) . |
| 8-250914 | * | 9/1996 | (JP) . |
| 9-116314 | * | 5/1997 | (JP) . |
| WO96 42118 | | 12/1996 | (WO) . |

OTHER PUBLICATIONS

"Low–Profile Filter Using Open Disk Dual–Mode Dielectric Resonators," Ishikawa et al., Electronics & Communications in Japan, Part II—Electronics, US, Scripta Technica., New York, vol. 79, No. 3, pp. 16–24, Dec. 1995.
European Search Report dated Feb. 4, 2000.

* cited by examiner

*Primary Examiner*—Robert Pascal
*Assistant Examiner*—Barbara Summons
(74) *Attorney, Agent, or Firm*—Ostrolenk, Faber, Gerb & Soffen, LLP

(57) ABSTRACT

A dielectric resonator designed so that there is substantially no loss in a conductor on the surface of a casing forming a shielded cavity, and so that the unloaded Q and the resonant frequency can be changed independently of each other. A cylindrical dielectric block having a pair of electrodes formed respectively on its two opposite surfaces is disposed in a metallic shielded-cavity casing so that one of the electrodes is in contact with an inner bottom surface of the shielded-cavity casing. This electrode is electrically connected to the shielded-cavity casing by soldering or the like. Input/output connectors are coupled to the other electrode on the cylindrical dielectric block.

17 Claims, 10 Drawing Sheets

TM MODE DIELECTRIC RESONATOR AND TM MODE DIELECTRIC FILTER AND DUPLEXER USING THE RESONATOR

This is a division of application Ser. No. 08/924,040, filed Aug. 29, 1997, now U.S. Pat. No. 6,052,041.

BACKGROUND OF THE INVENTION

1. Field of the Invention

The present invention relates to a transverse magnetic (TM) mode dielectric resonator and to a TM mode dielectric filter and duplexer using the resonator.

2. Description of the Related Art

A known dielectric filter using a TM mode dielectric resonator is shown in FIG. 13. Each of the dielectric resonators shown in FIG. 13 is a dual mode type comprising a plurality of dielectric blocks of short-circuit type $TM_{110}$ mode dielectric resonators which are integrally combined in a crisscross fashion. This structure enables each TM mode dielectric resonator to have the function of two TM mode dielectric resonators while being equal in size to one ordinary dielectric resonator of this kind.

Referring to FIG. 13, a dielectric filter 101 has four TM dual mode dielectric resonators 102, 103, 104, and 105, which are arranged in a row in respective cavity casings, with the openings defined by the respective cavity casings facing in the same direction. Metallic panels 106 and 107 are attached to these dielectric resonators so as to cover the openings.

The TM dual mode dielectric resonator 102 has a cavity casing 102*a* having openings on the front and rear sides as viewed in FIG. 13, and a dielectric crisscross block 102XY. The cavity casing 102*a* and the dielectric crisscross block 102XY are integrally formed of the same dielectric material. A conductor 102*b* is formed on the outer surface of the cavity casing 102*a* except on the front and rear opening edges. The cavity casing l02*a* with the conductor 102*b* forms a shielded cavity. The dielectric block 102XY is formed of a horizontal portion 102X and a vertical portion 102Y as viewed in FIG. 13. Thus, the TM dual mode dielectric resonator 102 forms a two-stage resonator. Each of the TM dual mode dielectric resonators 103, 104, and 105 has the same structure as the TM dual mode dielectric resonator 102.

An input loop 108 and an output loop 109 are mounted on the panel 106. The input loop 108 and the output loop 109 are connected to external circuits via coaxial connectors (not shown).

Coupling loops 107*a*, 107*b*, 107*c*, and 107*d* for coupling each adjacent pair of the TM dual mode dielectric resonators are mounted on the panel 107.

In dielectric resonators for use in such a dielectric filter, the resonant frequency of each dielectric resonator is determined by the size of the cavity and the size of the dielectric block.

For example, in the case of an ordinary $TM_{110}$ mode dielectric resonator having a single vertical dielectric block structure, the resonant frequency becomes lower if the width of the cavity is increased while the width, thickness and height of the dielectric block and the height of the cavity are fixed. The resonant frequency becomes lower if the width or thickness of the dielectric block is increased while the size of the cavity is fixed. Also, when the frequency is fixed, an increase in the unloaded Q of the dielectric resonator is attained by increasing the height of the dielectric block.

In such a case, if the height of the dielectric block is increased, the height of the cavity is necessarily increased. But since a real current flows through the conductor on the cavity casing surface in the $TM_{110}$ mode dielectric resonator, the loss in the conductor on the cavity casing surface becomes larger when the size of the cavity casing is increased. However, the increase in unloaded Q achieved by enlarging the cavity is sufficiently large to compensate for the loss in the conductor on the cavity casing surface. Consequently, the unloaded Q becomes higher when the height of the dielectric block is increased.

If the loss in the conductor on the cavity casing surface can be reduced, the unloaded Q can be further increased while limiting the increase in the height of the dielectric block. Therefore, there has been a need for a dielectric resonator designed to have reduced loss in the conductor on the cavity casing surface.

In the TM dual mode dielectric resonator shown in FIG. 13, when the sizes of the vertical and horizontal portions of the dielectric block are adjusted to obtain a predetermined frequency, the size of the cavity is also affected. To increase the unloaded Q, therefore, it is necessary to increase both the width and height of the cavity, resulting in an increase in the overall size of the dielectric filter. Also, the resonant frequency becomes lower if the cavity size is increased while the size of the dielectric block is fixed. Therefore, if the size of the cavity is increased, the width or thickness of the dielectric block is necessarily reduced. Thus, in the conventional TM dual mode dielectric resonator, it is difficult to independently change both the unloaded Q and the frequency.

SUMMARY OF THE INVENTION

In view of the above-described problems, the present invention is able to provide a dielectric resonator which has substantially reduced loss in the conductor on the cavity casing surface, and in which the unloaded Q and the resonant frequency can be changed independently of each other.

Another advantage of the present invention is to provide a dielectric filter and a dielectric duplexer having an improved unloaded Q and having a reduced thickness.

To achieve these advantages, according to a first aspect of the present invention, there is provided a TM mode dielectric resonator comprising a shielded-cavity casing having electrical conductivity, and at least one dielectric block disposed in the shielded-cavity casing, wherein electrodes are formed on two surfaces of the dielectric block opposite from each other, and one of the two surfaces on which the electrodes are formed is placed on an inner surface of the shielded-cavity casing.

In this structure, substantially no real current flows in the shielded-cavity casing corresponding to the cavity casing of the conventional TM mode dielectric resonator.

According to a second aspect of the present invention, a plurality of the above-described dielectric blocks are superposed one on another so that at least one of the two surfaces of each dielectric block on which the electrodes are formed is in contact with the adjacent surface of another of the dielectric blocks.

The unloaded Q of the resonator according to the first aspect of the invention can be further improved by using this structure.

According to a third aspect of the present invention, a plurality of the above-described dielectric blocks are superposed one on another so that at least one of the two surfaces of each dielectric block on which the electrodes are formed is opposed to the adjacent surface of another of the dielectric blocks while being spaced apart from the same.

This structure enables use of the dielectric resonator of the present invention as a multi-stage resonator.

According to a fourth aspect of the present invention, a thin-film multilayer electrode formed by alternately superposing thin-film conductors and thin-film dielectrics is used. If the electrodes are formed in this manner, the loss in the electrodes formed on the upper and lower surfaces of the dielectric block in the resonator according to the first aspect of the invention can be reduced, thereby further improving the unloaded Q.

According to a fifth aspect of the present invention, the dielectric block is formed into a cylindrical shape, thereby reducing the loss at the edge of the electrode, as compared to that in the electrode on a dielectric block in the form of a polygonal prism.

According to a sixth aspect of the present invention, the above-described TM mode dielectric resonator is externally coupled to input and output means. A dielectric filter having a high unloaded Q can be obtained by being constructed in this manner.

According to a seventh aspect of the present invention, coupling structures are disposed between the TM mode dielectric resonator and the input and output means.

By changing, adding or removing coupling structures, it is possible to easily control the degree of coupling between the TM mode dielectric resonator and the input and output means.

According to an eighth aspect of the present invention, coupling means are disposed between a plurality of TM mode dielectric resonators.

By changing, adding or removing coupling structures, is possible to easily control the degree of coupling between the TM mode dielectric resonators by changing, adding or removing coupling means.

According to a ninth aspect of the present invention, each coupling structure comprises an electrode sheet formed of a dielectric sheet and an electrode formed on one surface of the dielectric sheet.

By suitably selecting the dielectric constant of the dielectric and the size of the electrode sheet, it is possible to easily obtain the desired degree of coupling.

According to a tenth aspect of the present invention, in a plurality of TM mode dielectric resonators, the respective resonant operating frequencies of the initial-stage and final-stage are increased relative to the resonant frequencies of the other TM mode dielectric resonators, thereby equalizing the resonant frequencies of the TM mode dielectric resonators when the resonators are combined to form a dielectric filter.

According to an eleventh aspect of the present invention, a plurality of TM mode dielectric filters described above are combined to form a first TM mode dielectric filter having a first frequency band and a second TM mode dielectric filter having a second frequency band, and the first frequency band and the second frequency band are made different from each other. In this manner, a dielectric duplexer having a higher unloaded Q can be obtained.

According to a twelfth aspect of the present invention, the shape of the TM mode dielectric resonator forming the first TM mode dielectric filter and the shape of the TM mode dielectric resonator forming the second TM mode dielectric filter are made different from each other to make the first frequency band and the second frequency band different from each other. This feature eliminates the need for adding a circuit for relatively shifting the frequency bands, although such a circuit is required in the case of using TM mode dielectric resonators equal in shape.

According to a thirteenth aspect of the present invention, the first TM mode dielectric filter is adapted for use as a transmitting filter while the second TM mode dielectric filter is adapted for use as a receiving filter. In this manner, a TM mode dielectric duplexer for use with a transmitter-receiver and having a higher unloaded Q can be obtained.

DESCRIPTION OF EMBODIMENTS OF THE INVENTION

Figure 1A:
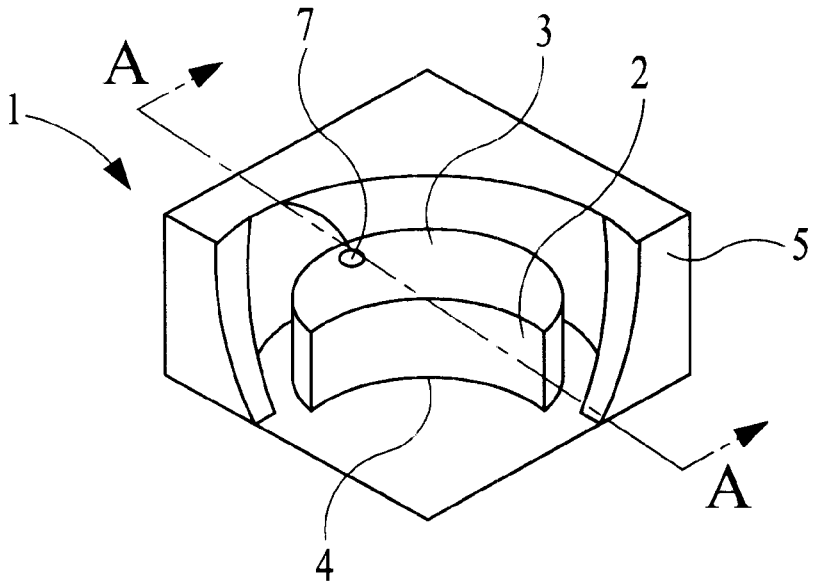
FIG. 1A is a partially fragmentary perspective view of a dielectric filter which represents a first embodiment of the present invention.

A dielectric filter which represents a first embodiment of the present invention will be described with reference to FIGS. 1A and 1B. FIG. 1A is a partially fragmentary perspective view of a dielectric filter 1, and FIG. 1B is a cross-sectional view taken along the line A—A of FIG. 1A.

Figure 1B:
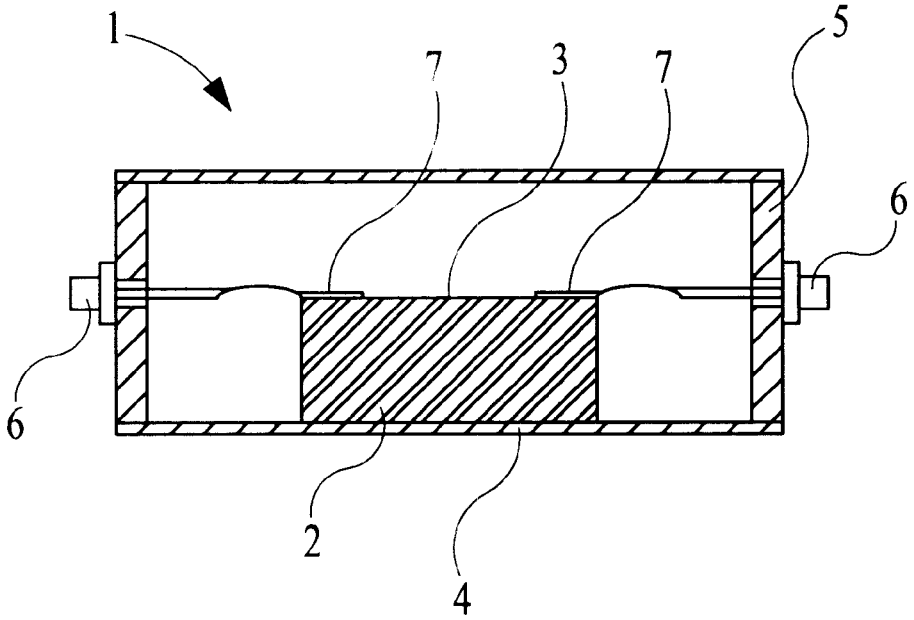
FIG. 1B is a cross-sectional view taken along the line A—A of FIG. 1A.

As shown in FIGS. 1A and 1B, the dielectric filter 1 has a dielectric block 2 provided in a casing 5 made of a metal and forming a shielded cavity.

The dielectric block 2 is a cylindrical member formed of a dielectric material. Electrodes 3 and 4 are formed on two opposite surfaces of the dielectric block 2. The dielectric block 2 is placed so that the electrode 4 is in contact with an inner bottom surface of the shielded-cavity casing 5. The electrode 4 is fixed and electrically connected to the shielded-cavity casing 5 by soldering or the like. The electrode 3 of the dielectric block 2 faces an inner ceiling surface of the shielded-cavity casing 5 and is uniformly spaced apart from this surface. When a high-frequency signal is input to the thus-constructed dielectric filter 1, an electric field is generated between the electrodes 3 and 4 in the dielectric block 2 and a magnetic field is generated along the circumference of the dielectric block 2. As a result, an electromagnetic field is concentrated at and confined in the dielectric block 2 in an electromagnetic field distribution approximate to a $TM_{010}$ mode. At this time, the dielectric block 2 functions as a one-stage dielectric resonator.

A pair of coaxial connectors 6 for external input and output are attached to side wall potions of the shielded-cavity casing 5. Center electrodes of the coaxial connectors 6 are electrically connected to electrodes sheets 7 by, for example, wires.

Each of the electrode sheets 7 is formed of a sheet of an insulating material such as a resin and an electrode film formed on the upper surface of the insulating material sheet. No electrode film is formed on the lower surface of the insulating material sheet. The electrode sheets 7 are disposed on and attached to the electrode 3 formed on the upper surface of the dielectric block 2. The lower surfaces of the electrode sheets 7, on which no electrode film are formed, are brought into contact with the electrode 3.

The thus-constructed dielectric filter 1 functions as described below.

A high-frequency signal is input to one of the coaxial connectors 6. The capacitance across the insulating material between the electrode 3 of the dielectric block 2 and the electrode film on the upper surface of one of the electrode sheets 7 connected to the center electrode of the coaxial connector 6 acts for coupling between the center electrode of the coaxial connector 6 and the dielectric block 2. The dielectric block 2 resonates with the input signal by this coupling. A signal is thereby output through the capacitance of the other electrode sheet 7 and through the other coaxial connector 6 connected to the electrode film on this electrode sheet 7.

The thus-arranged dielectric filter can be much smaller in thickness than the conventional dielectric filter using short-circuit type $TM_{110}$ mode dielectric resonators. The resonant frequency and the unloaded Q of the dielectric filter of this embodiment are determined by the same factors as the conventional dielectric filter using short-circuit type $TM_{110}$ mode dielectric resonators. That is, the resonant frequency is determined by the sectional area along a plane perpendicular to the direction of height while the unloaded Q is determined by the height of the dielectric block. In this embodiment, however, substantially no real current flows through the side surface of the shielded-cavity casing corresponding to the conventional cavity casing. Accordingly, substantially no deterioration in unloaded Q results with respect to this portion. Consequently, the increase in the height of the dielectric block necessary for obtaining the desired unloaded Q can be limited, thereby limiting the increase in the height of the entire dielectric filter.

The first embodiment of the present invention has been described with respect to use of a cylindrical dielectric block. However, such a cylindrical dielectric block is not exclusively used and dielectric blocks having any other shapes may also be used as long as they have electrodes corresponding to the two electrodes 3 and 4 shown in FIG. 1.

Among such dielectric blocks usable in accordance with the present invention, however, a cylindrical dielectric block, such as the dielectric block 2 of the embodiment described above, is used particularly advantageously for at least the following reason. On the surface of such a cylindrical dielectric block on which an electrode is formed, the distance from the center of the circle to the edge of the circle, i.e., the circumference, is constant. In other dielectric blocks in the form of polygonal prisms, the distance from the center to the vertices of the polygonal shape is greater than the distance from the center to other edge portions. In such dielectric blocks, therefore, a potential difference occurs, which causes a current at the edge of the electrode along the polygonal shape, resulting in occurrence of a loss in the electrode. In contrast, in a cylindrical dielectric block, substantially no current flows due to such a potential difference since the distance between the center of the circle and the circumference of the surface on which the electrode is formed is constant. The resulting loss in this case is advantageously small. Because of the above-described effect of using a cylindrical shape, a superconductor, with which a serious problem of loss at the electrode edge may arise, can be used in the electrodes 3 and 4. If a superconductor is used as the electrodes 3 and 4, a dielectric resonator or filter having a higher unloaded Q can be obtained.

Figure 2A:
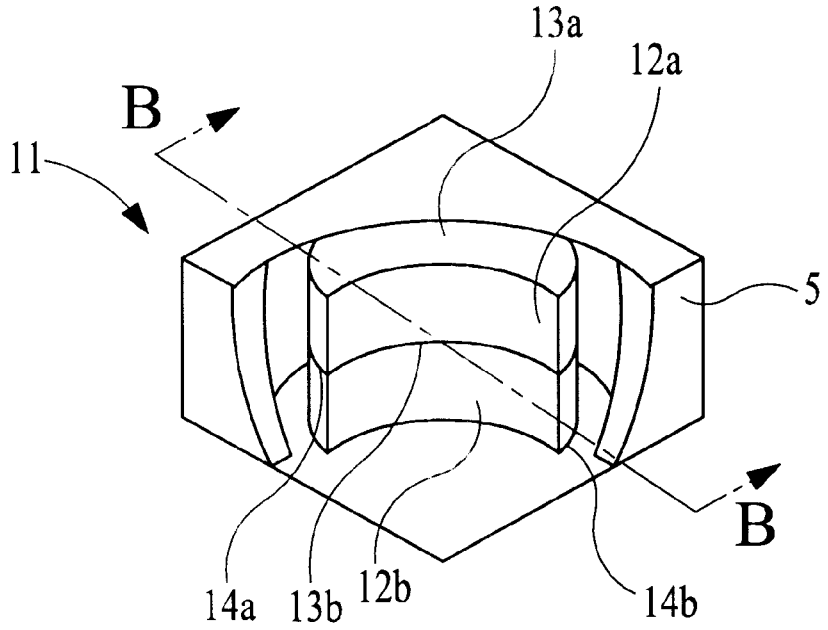
FIG. 2A is a partially fragmentary perspective view of a dielectric filter which represents a second embodiment of the present invention.
Figure 2B:
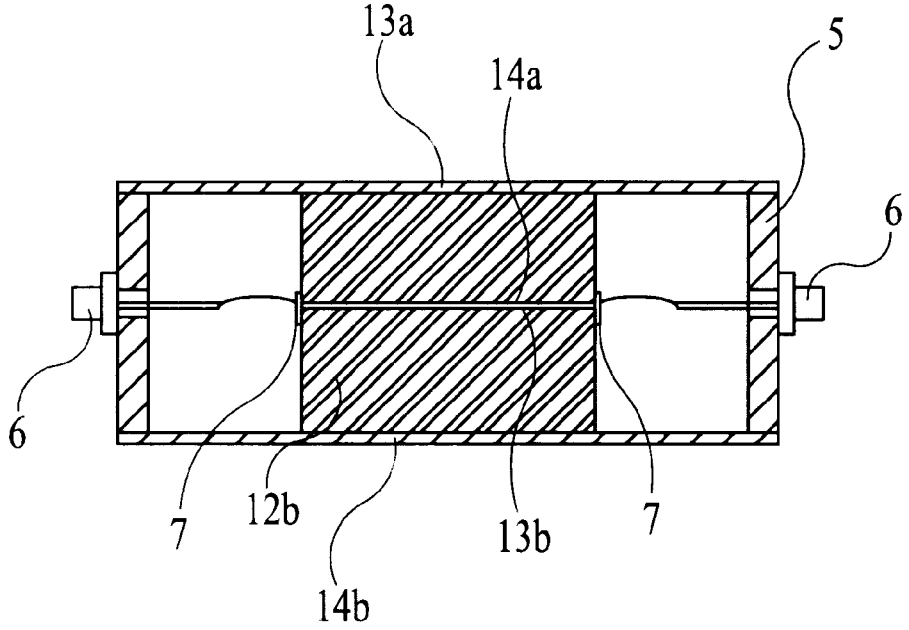
FIG. 2B is a cross-sectional view taken along the line B—B of FIG. 2A.

A second embodiment of the present invention will next be described with reference to FIGS. 2A and 2B. FIG. 2A is a partially fragmentary perspective view and FIG. 2B is a cross-sectional view taken along the line B—B of FIG. 2A. Components of this embodiment identical to those of the first embodiment are indicated by the same reference numerals and will not be described in detail.

Referring to FIGS. 2A and 2B, a dielectric filter 11 has dielectric blocks 12*a* and 12*b* disposed in a metallic shielded-cavity casing 5.

Electrodes 13*a* and 14*a* are formed on two opposite surfaces of the dielectric block 12*a*. Electrodes 13*b* and 14*b* are formed on two opposite surfaces of the dielectric block 12*b*. The electrode 13*a* of the dielectric block 12*a* is fixedly connected to an inner ceiling surface of the shielded-cavity casing 5 by soldering or the like while the electrode 14*b* of the dielectric block 12*b* is fixedly connected to an inner bottom surface of the shielded-cavity casing 5 by soldering or the like. The electrode 14*a* of the dielectric block 12*a* and the electrode 13*b* of the dielectric block 12*b* are electrically connected to each other.

Electrode sheets 7 are formed in the same manner as those in the first embodiment. Each of electrode sheets 7 is attached to the joint between the dielectric blocks 12*a* and 12*b*, the surface of the electrode sheet 7 on which no electrode film is formed being in contact with the dielectric blocks 12*a* and 12*b*. If the balance of an electromagnetic field distribution through the upper and lower dielectric blocks is considered, it is preferable to attach the electrode sheets 7 to the joint between the dielectric blocks 12*a* and 12*b*. However, the electrode sheets 7 may be attached to other portions.

The center electrodes of the coaxial connectors 6 attached to side surfaces of the shielded-cavity casing 5 are electrically connected to the electrode films on the electrode sheets 7 by, for example, wires. The center electrodes of the coaxial connectors 6 may be directly connected to the electrodes 13*b* and 14*a* without using electrode sheets 7. In such a case, a wide-band dielectric filter can be formed because the degree of external coupling is maximized.

The thus-constructed dielectric filter 11 functions as a one-stage dielectric filter and has an improved unloaded Q in comparison with the dielectric filter of the first embodiment if these dielectric filters are equal in height.

Figure 3A:
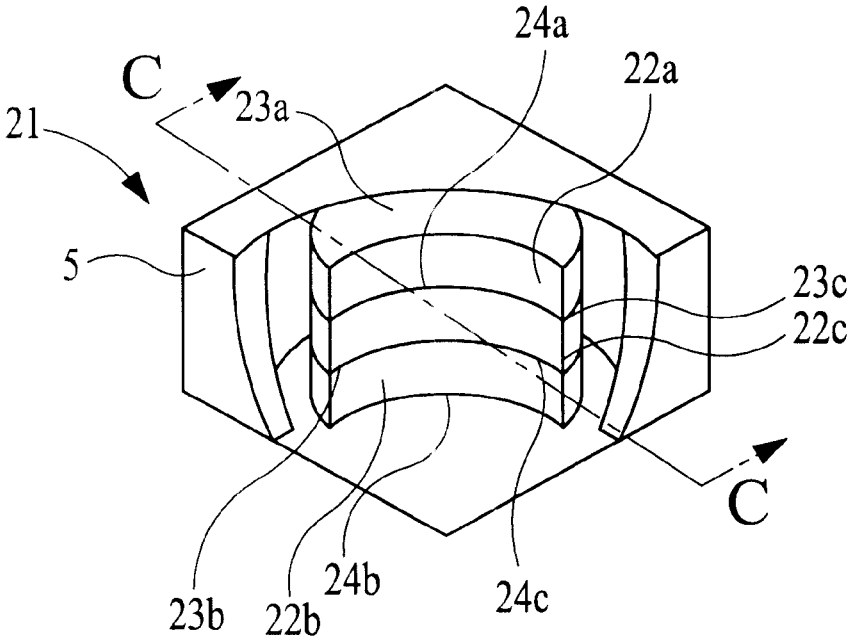
FIG. 3A is a partially fragmentary perspective view of a modification of the dielectric filter shown in FIGS. 2A and 2B.
Figure 3B:
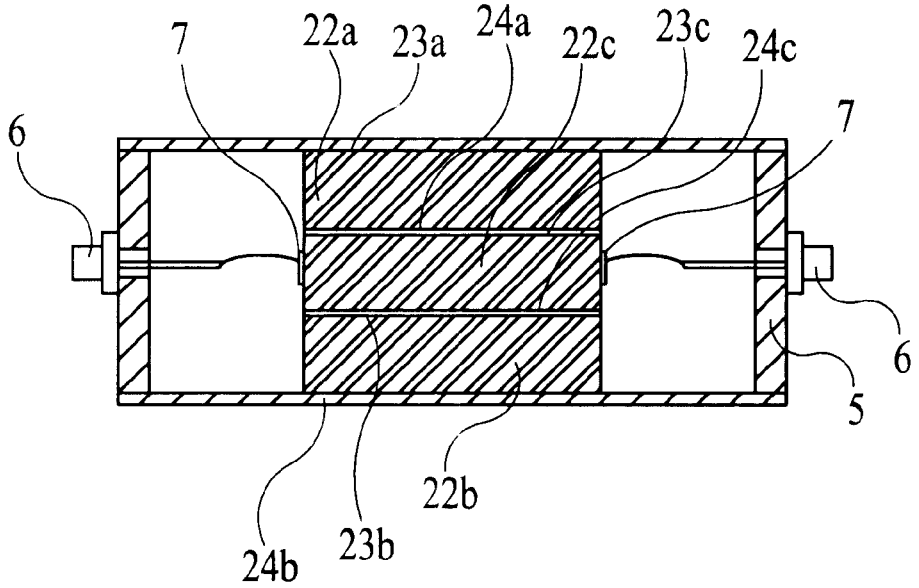
FIG. 3B is a cross-sectional view taken along the line C—C of FIG. 3A.

A modification of this embodiment such as that shown in FIGS. 3A and 3B may be made. FIG. 3A is a partially fragmentary perspective view and FIG. 3B is a cross-sectional view taken along the line C—C of FIG. 3A. Components of this embodiment identical to those of the first or second embodiment are indicated by the same reference numerals and will not be described in detail.

Referring to FIG. 3A and 3B, dielectric blocks 22*a* and 22*b* constructed in the same manner as the dielectric block 2 shown in FIGS. 1A and 1B and the dielectric blocks 12*a* and 12*b* shown in FIGS. 2A and 2B are placed in a shielded-cavity casing 5. The dielectric block 22*a* has a top electrode electrode 23*a* and a bottom electrode 24*a*. The dielectric block 22*b* has a top electrode 23*b* and a bottom electrode 24*b*. A dielectric block 22*c*, newly provided, having a top electrode 23*c* and a bottom electrode 24*c*, is interposed between the dielectric blocks 22*a* and 22*b*, thus constructing a dielectric filter 21. In this arrangement, the dielectric blocks 22*a* and 22*c* form a one-stage resonator and the dielectric blocks 22*b* and 22*c* also form a onestage resonator. Accordingly, the dielectric blocks 22*a* to 22*c* superposed one on another in the dielectric filter 21 shown in FIGS. 3A and 3B function as a dual mode dielectric resonator, so that the dielectric filter 21 can be used as a filter having a two-stage resonator. On the basis of this structure, a dielectric filter having n-1 dielectric resonator stages may be constructed by further superposing dielectric blocks so as to form a stack of n dielectric blocks.

The above-described TM dual mode dielectric resonator of this embodiment having the structure shown in FIGS. 3A and 3B uses dielectric blocks thin enough to reduce the overall thickness relative to that of the conventional short-circuit type TM dual mode dielectric resonator having the same resonant frequency.

In this embodiment, as well as in the first embodiment, the shape of the dielectric blocks is not limited to a cylindrical shape and may have the shape of any polygonal prism. Also, the shapes of the plurality of dielectric blocks of the dielectric filter shown in FIGS. 2A and 2B or 3A and 3B may be varied. However, it is preferred that each of the dielectric blocks be formed into a cylindrical shape for the reason described above with respect to the first embodiment.

Figure 4A:
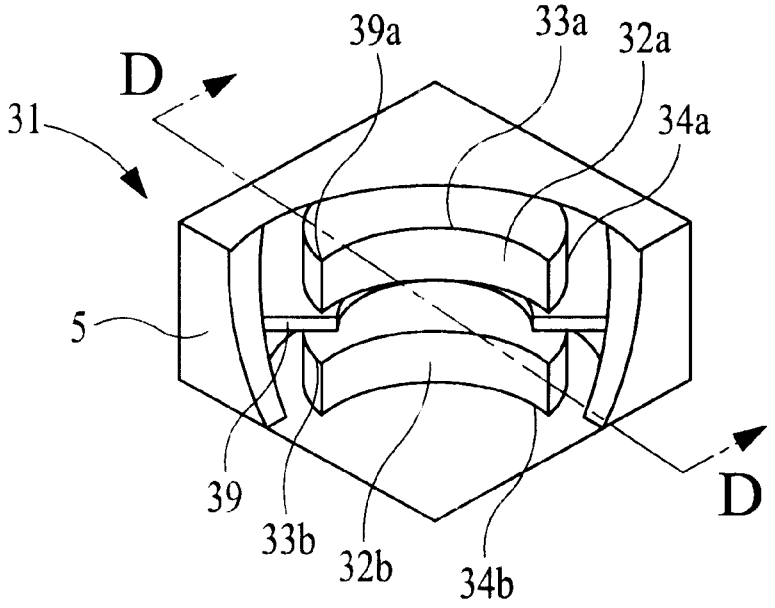
FIG. 4A is a partially fragmentary perspective view of a dielectric filter which represents a third embodiment of the present invention.
Figure 4B:
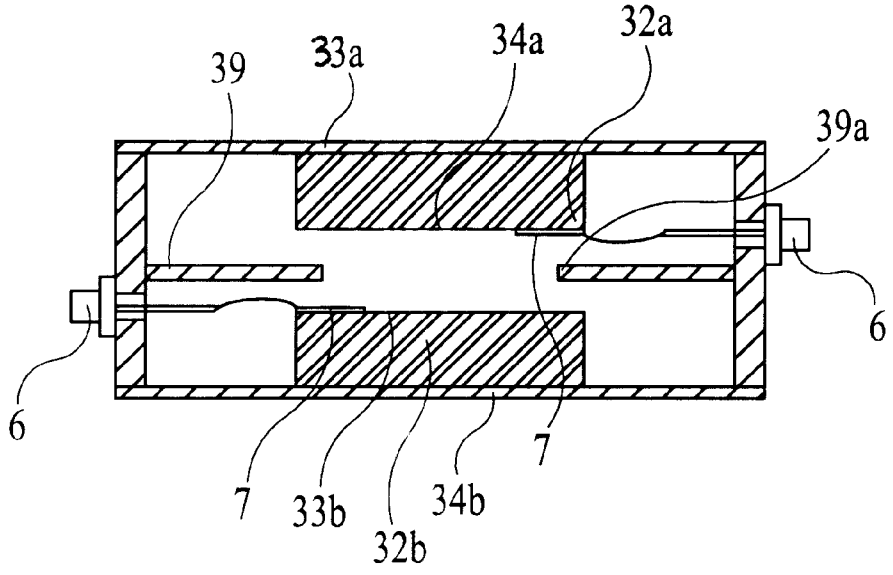
FIG. 4B is a cross-sectional view taken along the line D—D of FIG. 4A.

A third embodiment of the present invention will next be described with reference to FIGS. 4A and 4B. FIG. 4A is a partially fragmentary perspective view and FIG. 4B is a cross-sectional view taken along the line D—D of FIG. 4A. Components of this embodiment identical to those of the first or second embodiment are indicated by the same reference numerals and will not be described in detail.

Referring to FIG. 4A and 4B, a dielectric filter 31 has a structure wherein an electrode 34*a* of a dielectric block 32*a* and an electrode 33*b* of a dielectric block 32*b* are electrically insulated from each other by spacing therebetween. The dielectric block 32*a* has a top electrode 33*a* and the dielectric block 32*b* has a bottom electrode 34*b*. The dielectric blocks 32*a* and 32*b* function as resonators independent of each other, such that the dielectric filter 31 is formed of a two-stage resonator.

A coupling control plate 39 having a coupling control hole 39*a* formed generally at its center is disposed between the electrode 34*a* of the dielectric block 32*a* and the electrode 33*b* of the dielectric block 32*b*. The degree of coupling between the resonator formed by the dielectric block 32*a* and the resonator formed by the dielectric block 32*b* is controlled by selecting the size of the coupling control hole 39*a*. If the coupling control hole 39*a* is larger, the degree of coupling between the resonator formed by the dielectric block 32*a* and the resonator formed by the dielectric block 32*b* is higher. If the coupling control hole 39*a* is smaller, the degree of coupling between the resonator formed by the dielectric block 32*a* and the resonator formed by the dielectric block 32*b* is lower.

In this embodiment, as well as in the first and second embodiments, the shape of the dielectric blocks is not limited to a cylindrical shape. Also, the shapes of the two dielectric blocks used may be different from each other. However, it is preferred that each of the dielectric blocks be formed into a cylindrical shape for the reason described above with respect to the first embodiment.

Figure 5A:
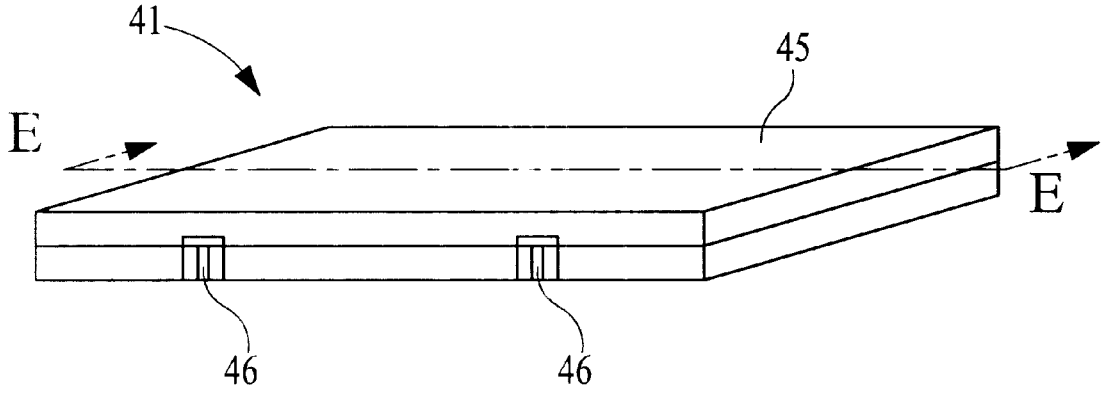
FIG. 5A is a partially fragmentary perspective view of a dielectric filter which represents a fourth embodiment of the present invention.
Figure 5B:
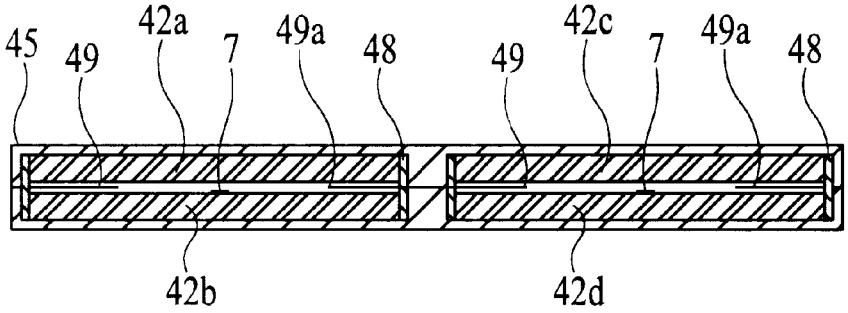
FIG. 5B is a cross-sectional view taken along the line E—E of FIG. 5A.
Figure 6:
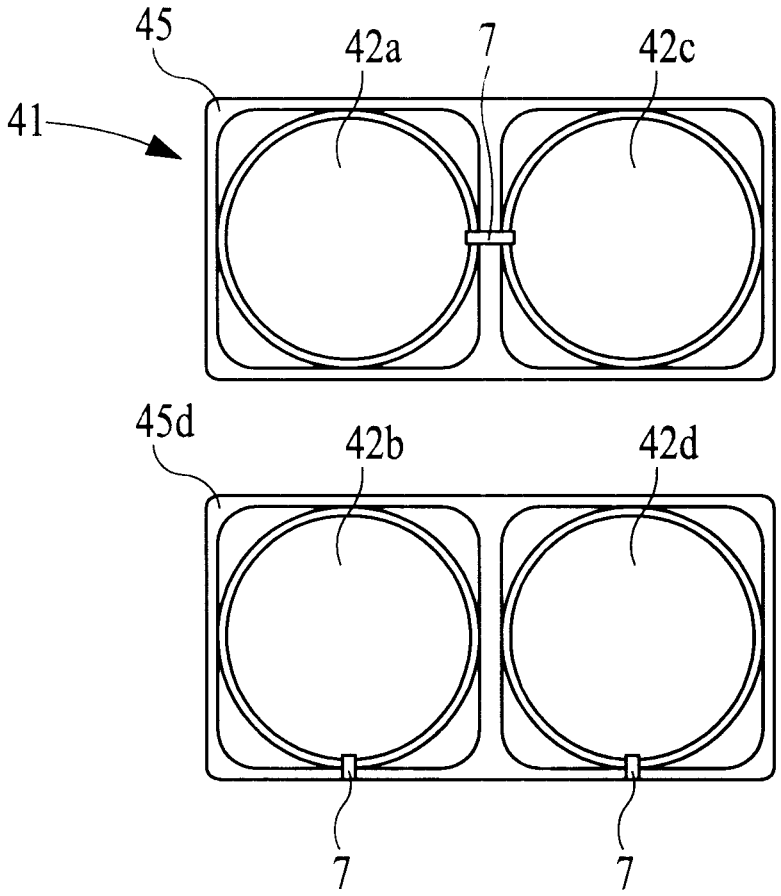
FIG. 6 comprises plan views of inner portions of upper and lower sections of the dielectric filter shown in FIGS. 5A and 5B.

A fourth embodiment of the present invention will next be described with reference to FIGS. 5A, 5B, and 6. FIG. 5A is a partially fragmentary perspective view and FIG. 5B is a cross-sectional view taken along the line E—E of FIG. 5A. FIG. 6 comprises plan views of upper and lower sections of the dielectric filter shown in FIGS. 5A and 5B. Supporting members 48 shown in FIGS. 5B are omitted in FIG. 6. In this embodiment, a dielectric filter 41 formed of a four-stage resonator is constructed by disposing, in a side-by-side fashion, two dielectric filters 31 described above as the third embodiment. Components of this embodiment identical to those of the first, second or third embodiment are indicated by the same reference numerals and will not be described in detail.

Referring to FIGS. 5A and 5B, the dielectric filter 41 has four cylindrical dielectric blocks 42*a* to 42*d*, and pairs of electrodes (not numbered in the figures) are respectively formed on two major opposite surfaces of the dielectric blocks 42*a* to 42*d*.

The structure of each of the dielectric blocks 42*a* to 42*d* is the same as that of the above-described dielectric blocks of the first to third embodiments, and will not be described in detail.

The shielded-cavity casing 45 is formed of a dielectric material having the same thermal expansion coefficient as the dielectric blocks 42*a* to 42*d*, and an electrode formed on its outer surface and, therefore, has the same shielding function as a metallic shielded-cavity casing. Since the shielded-cavity casing 45 has the same thermal expansion coefficient as the dielectric blocks, it is free from the problem of the difference between the thermal expansion coefficients of a metal and a dielectric. The shielded-cavity casing 45 is formed by combining separate upper and lower sections. Recesses for accommodating the dielectric blocks 42*a* to 42*d* are formed in each of the upper and lower sections. Further, input/output electrodes 46 are formed on one of the side surfaces of the shielded-cavity casing 45 while being electrically separated from the electrode formed on the outer surface of the shielded-cavity casing 45. The input/output electrodes 46 extend vertically from the bottom surface of the shielded-cavity casing 45 used as a mounting surface.

One of the input/output electrodes 46 is coupled to the dielectric block 42*b* through an electrode sheet 7. The dielectric block 42*b* is coupled to the dielectric block 42*a* uniformly spaced apart from the dielectric block 42*b*. The dielectric block 42*a* is in turn coupled to the dielectric block 42*c* adjacent to the dielectric block 42*a* through an electrode sheet 7. Further, the dielectric block 42*c* is coupled to the dielectric block 42*d* uniformly spaced apart from the dielectric block 42*c*. The dielectric block 42*d* is coupled to the other input/output electrode 46 through an electrode sheet 7.

A supporting member 48 made of a dielectric material having a smaller dielectric constant is disposed between the dielectric blocks 42*a* and 42*b* and uniformly spaces these dielectric blocks from each other. Another supporting member 48 is disposed between the dielectric blocks 42*c* and 42*d* for the same purpose. A coupling control plate 49 made of a metal is integrally combined with each supporting member 48 by being partially embedded in the supporting member 48. Each coupling control plate 49 has a coupling control hole 49*a* for controlling the coupling between the dielectric blocks 42*a* and 42*b* or the dielectric blocks 42*c* and 42*d*.

The thus-constructed dielectric filter can be smaller in thickness and is capable of being surface-mounted.

The dielectric blocks 42*a* to 42*d* may have different characteristic resonant frequencies. That is, in the dielectric blocks 42*b* and 42*d* coupled to the input/output electrodes 46 and respectively forming the initial-stage and final-stage dielectric resonators, the circumferential side surface on which no electrode is formed is partially cut off to adjust the resonance frequency of the corresponding dielectric resonator to a frequency higher than that of the resonators formed by the other dielectric blocks 42*a* and 42*c*. This is because, when input and output means are respectively coupled to the initial-stage and final-stage dielectric resonators by capacitive coupling, the capacitance due to each coupling reduces the apparent resonant frequency of each of the initial-stage and final-stage dielectric resonators by such an amount that the desired filtering characteristic of the dielectric filter formed by the dielectric resonators cannot be obtained. Therefore, to prevent this phenomenon, the resonant frequency of each of the initial-stage and final-stage dielectric resonators in the state of operating alone is increased so that the apparent resonant frequencies of all the dielectric resonators become approximately equal to each other when the dielectric resonator is formed.

Figure 7:
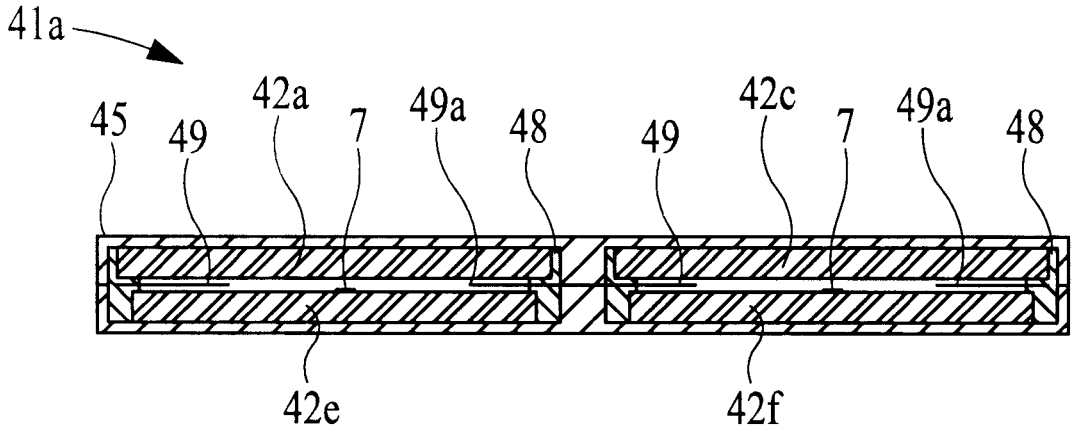
FIG. 7 is a cross-sectional view of a modification of the dielectric filter shown in FIGS. 5A, 5B, and 6.

A structure such as shown in FIG. 7 may alternatively be used as means for increasing the resonant frequency of each of the initial-stage and final-stage dielectric resonators. FIG. 7 is a cross-sectional view of a dielectric filter 41*a* corresponding to the cross section of the dielectric filter shown in FIG. 5B.

As shown in FIG. 7, dielectric blocks 42*e* and 42*f* smaller in diameter than the dielectric blocks 42*b* and 42*d* forming the initial-stage and final-stage dielectric resonators are provided in place of the dielectric blocks 42*b* and 42*d*. That is, the dielectric block 42*e* is provided in the initial stage while the dielectric block 42*f* having the same diameter as the dielectric block 42*e* is provided in the final stage, thereby increasing the resonant frequency of each of the initial-stage and final-stage dielectric resonators in the state of operating alone.

In this embodiment, as well as in the first to third embodiments, the shape of the dielectric blocks is not limited to a cylindrical shape. Also, the shape of one of the plurality of dielectric blocks may be changed. However, it is preferred that each of the dielectric blocks be formed into a cylindrical shape for the reason described above with respect to the first embodiment.

In this embodiment, the input and output connectors are not coaxial connectors such as those used in the first, second or third embodiment but surface mount type input/output electrodes. In this embodiment, however, coaxial connectors arranged in the same manner as those in the first, second or third embodiment may alternatively be used. Needless to say, the input/output electrode structure of this embodiment suitable for surface mounting may be used in place of the coaxial connectors in the dielectric filters described above as the first to third embodiments.

Figure 8:
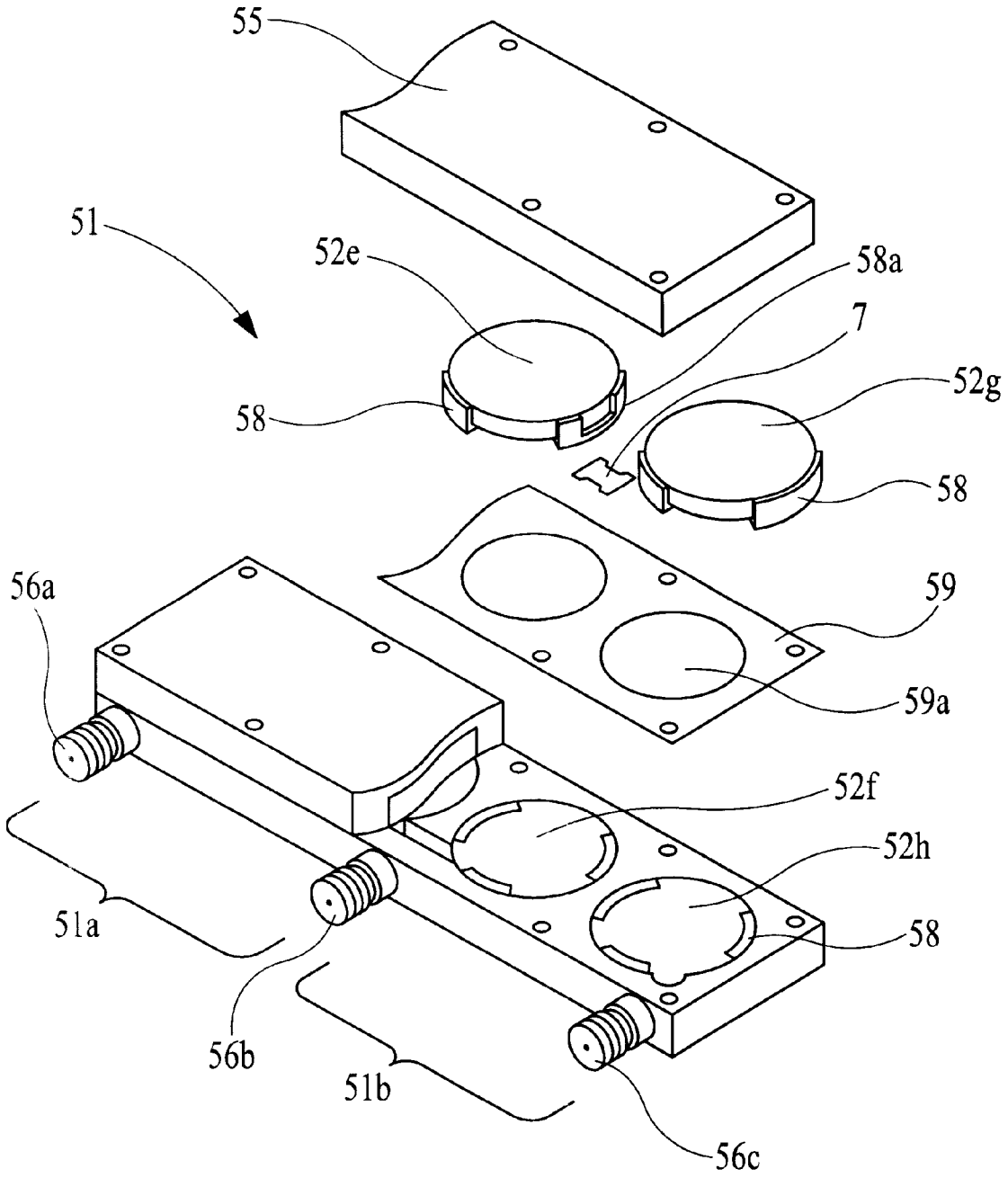
FIG. 8 is a partially fragmentary perspective view of a dielectric duplexer which represents a fifth embodiment of the present invention.
Figure 9:
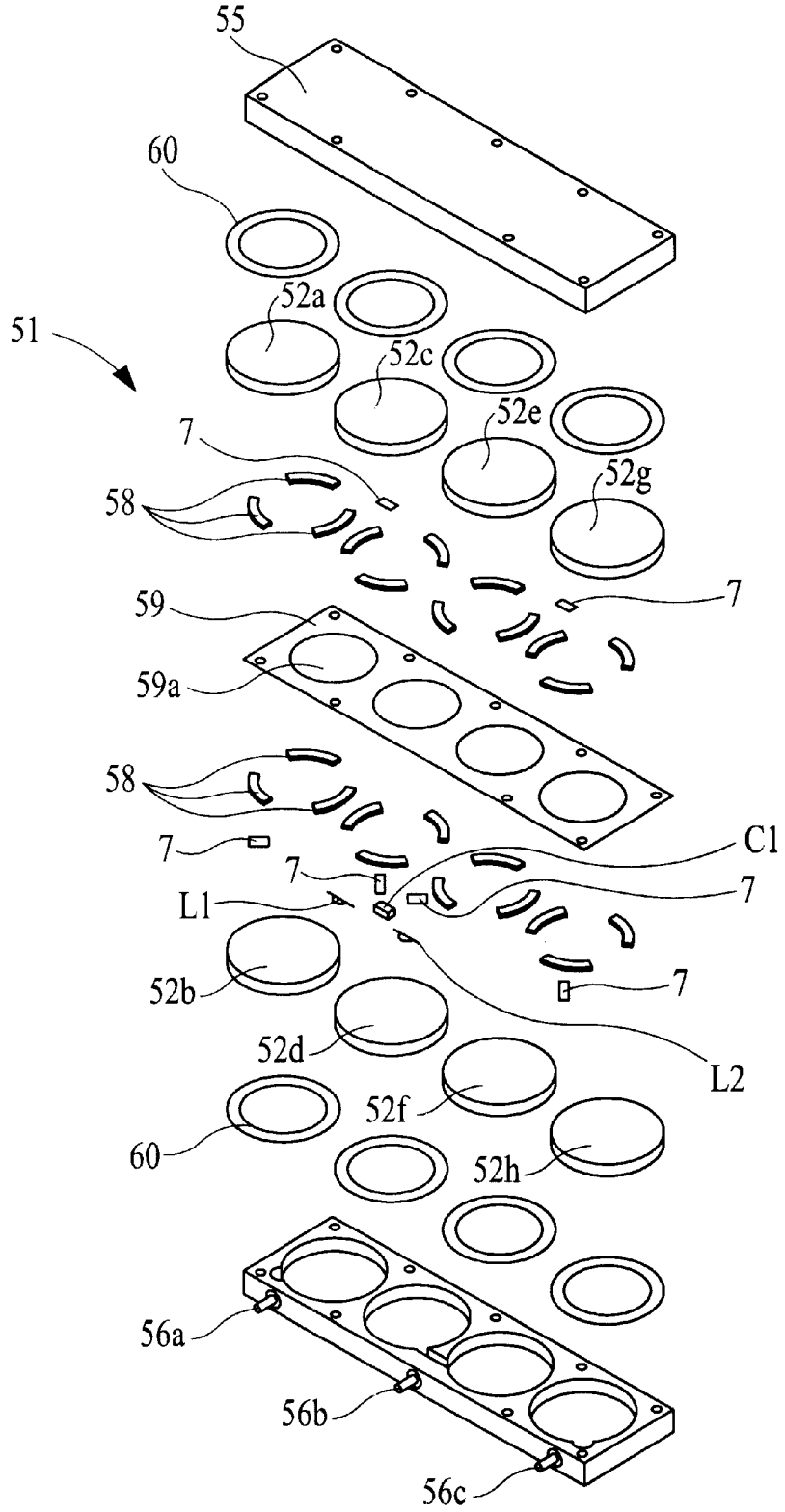
FIG. 9 is an exploded perspective view of the dielectric duplexer shown in FIG. 8.

A fifth embodiment of the present invention will next be described with reference to FIGS. 8 and 9. FIG. 8 is a partially fragmentary perspective view and FIG. 9 is an exploded perspective view. Components of this embodiment identical to those of the first, second, third or fourth embodiment are indicated by the same reference numerals and will not be described in detail.

Referring to FIG. 8, a dielectric duplexer 51 is formed of a first dielectric filter 51*a* having a first frequency band and a second dielectric filter 51*b* having a second frequency band.

The first dielectric filter 51*a* is formed of dielectric blocks 52*a* to 52*d* shown in FIG. 9. In the dielectric filter 51*a*, a coaxial connector 56*a* is coupled to the dielectric block 52*b* through an electrode sheet 7, and the dielectric block 52*b* is coupled to the dielectric block 52*a*. The dielectric block 52*a* is coupled to the dielectric block 52*c* through an electrode sheet 7. The dielectric block 52*c* is coupled to the dielectric block 52*d*, which is coupled to a coaxial connector 56*b* through an electrode sheet 7 and a coil L1 and a capacitor C1 provided for matching. Thus, the dielectric filter 51*a* having a four-stage dielectric resonator is formed, as shown in FIG. 8.

The second dielectric filter 51*b* is formed of dielectric blocks 52*e* to 52*h* shown in FIG. 9. In the dielectric filter 51*b*, a coaxial connector 56*b* is coupled to the dielectric block 52*f* through a capacitor C1 and a coil L2 provided for matching and through an electrode sheet 7. The dielectric block 52*f* is coupled to the dielectric block 52*e*. The dielectric block 52*e* is coupled to the dielectric block 52*g* through an electrode sheet 7. The dielectric block 52*g* is coupled to the dielectric block 52*h*, which is coupled to a coaxial connector 56*c* through an electrode sheet 7. Thus, the dielectric filter 51*b* having a four-stage dielectric resonator is formed, as shown in FIG. 8.

As shown in FIG. 9, a shielded-cavity casing 55 is formed by combining separate upper and lower sections. Recesses for accommodating the dielectric blocks 52*a* to 52*h* are formed in each of the upper and lower sections.

The dielectric blocks 52*a* to 52*h* are electrically connected to recessed surfaces of the shielded-cavity casing 55 by annular grounding plates 60.

As shown in FIG. 9, sets of supporting members 58 for supporting the dielectric blocks 52*a* to 52*h* and a coupling control plate 59 supported by being interposed between upper and lower supporting members 58 are provided between the groups of dielectric blocks 52*a*, 52*c*, 52*e*, and 52*g* and the group of dielectric blocks 52*b*, 52*d*, 52*f*, and 52*h*.

Supporting members 58 are made of a material having a small dielectric constant. Three supporting members 58 form one set for supporting one dielectric block in a three-point supporting manner. Cuts 58*a* are formed in the supporting members 58 to enable the electrode sheets 7 to be fixed by being pinched between the dielectric blocks and the supporting members 58*a*.

Coupling control holes 59*a* are formed in the coupling control plate 59. The diameter and the shape of the coupling control holes 59*a* are selected to control coupling between the dielectric blocks 52*a* and 52*b*, between the dielectric blocks 52*c* and 52*d*, between the dielectric blocks 52*e* and 52*f* and between the dielectric blocks 52*g* and 52*h*.

The thus-constructed dielectric duplexer 51 can be a low-loss, thin duplexer formed of an eight-stage dielectric resonator.

The initial-stage and final-stage dielectric blocks of the dielectric filters 51*a* and 52*b* of the dielectric duplexer 51 may be reduced in diameter, as are those in the above-described modification of the fourth embodiment.

Figure 10:
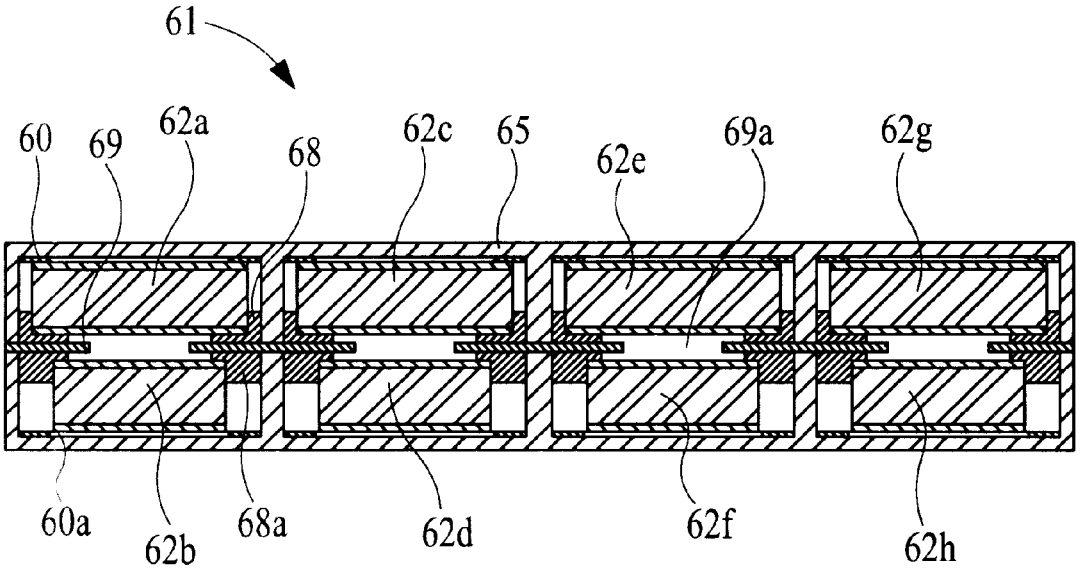
FIG. 10 is a cross-sectional view of a modification of the dielectric duplexer shown in FIG. 8 and 9.

FIG. 10 is a cross-sectional view of a dielectric duplexer 61 in which the diameters of the initial-stage and final-stage dielectric blocks of each of the dielectric filters are reduced. The structure related to the coaxial connectors of this dielectric duplexer is the same as that in the dielectric duplexer 51 shown in FIGS. 8 and 9, and its description will not be repeated. In FIG. 10 (and in FIG. 11 as described below) reference numerals 65, 68, 69 and 69*a* correspond respectively to 55, 58, 59 and 59*a* in FIGS. 8 and 9.

As shown in FIG. 10, the diameters of the dielectric blocks 62*b*, 62*d*, 62*f*, and 62*h* corresponding to the initial and final stages of the dielectric filters are reduced relative to those of the other dielectric blocks 62*a*, 62*c*, 62*e*, and 62*g*.

The shapes of supporting members 68*a* and grounding plates 60*a* for supporting the dielectric blocks 62*b*, 62*d*, 62*f*, and 62*h* are also changed according to the sizes of these dielectric blocks.

In this manner, the resonant frequencies of the initial-stage and final-stage dielectric resonators in the state of operating alone are increased to ensure that, in each of the first and second dielectric filters, the apparent resonant frequencies of the dielectric resonators are approximately equal to each other. Needless to say, the apparent resonant frequency of the dielectric resonators forming the first dielectric filter and the apparent resonant frequency of the dielectric resonators forming the second dielectric filter are set different from each other.

Figure 11:
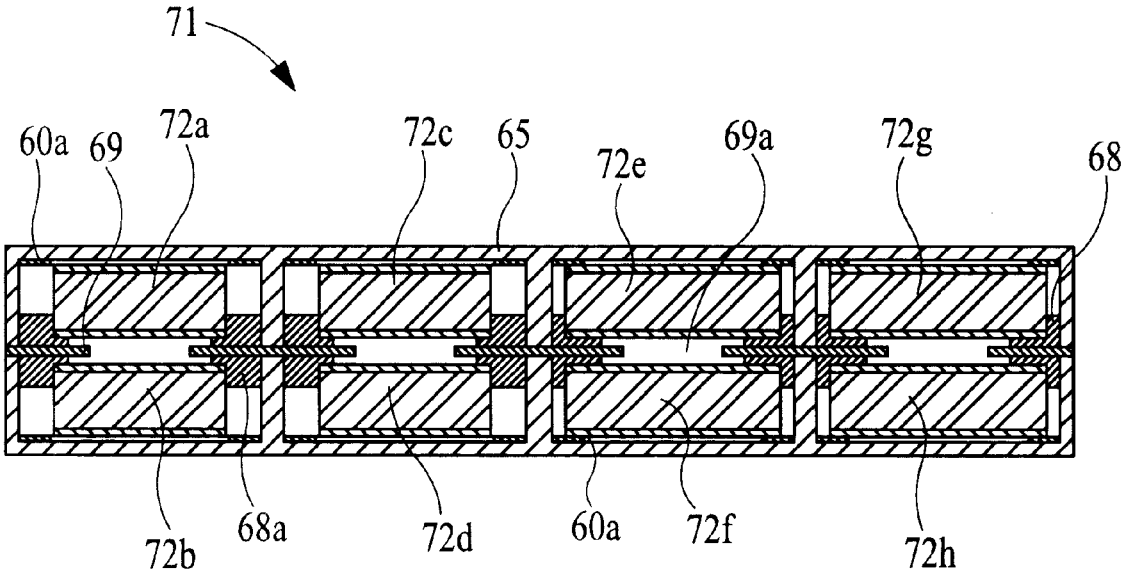
FIG. 11 is a cross-sectional view of another modification of the dielectric duplexer shown in FIG. 8 and 9.

A structure such as that as shown in FIG. 11 can also be used as a structure for enabling the first and second dielectric filters to have different frequency bands. The structure related to the coaxial connectors of the dielectric duplexer 71 shown in FIG. 11 is the same as that in the dielectric duplexer 51 shown in FIGS. 8 and 9, and its description will not be repeated.

As shown in FIG. 11, dielectric blocks 72*a* to 72*d* forming a first dielectric filter and dielectric blocks 72*e* to 72*h* forming second dielectric filter are made different in shape from each other; the dielectric blocks 72*a* to 72*d* are smaller in diameter than the dielectric blocks 72*e* to 72*h*, thereby enabling the first and second dielectric filters to have different frequency bands.

While, in this modification, the diameters of dielectric blocks are made different from each other, other various means for setting different frequency bands, e.g., making rectangular and cylindrical dielectric blocks, are also possible. The frequency bands of the first and second dielectric filters may be made different from each other by adding reactance elements such as capacitors and inductors without changing the shape of the dielectric blocks, or by cutting the dielectric blocks.

Each of the dielectric duplexers shown in FIGS. 8 to 11 can be used as a common antenna device for a transmitter-receiver in such a manner that the first frequency band of the first dielectric filter is used as a receiving frequency band of a receiving filter while the second frequency band is used as a transmitting frequency band of a transmitting filter. Also, the first and second dielectric filters may be used as two transmitting filters or two receiving filters.

A sixth embodiment of the present invention will next be described with reference to FIG. 12. This embodiment uses the same construction as that of the dielectric filter 1 shown in FIG. 1. Components or portions identical or corresponding to those shown in FIG. 1 are indicated by the same reference numerals and will not be described in detail.

Figure 12:
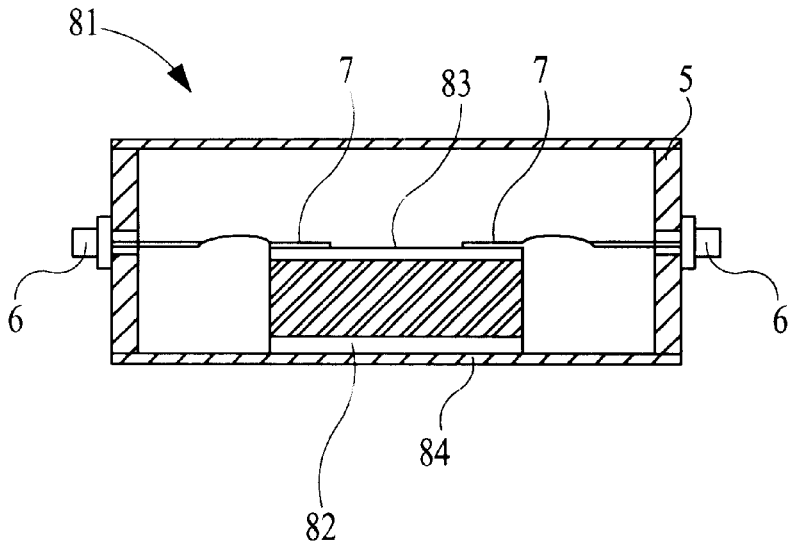
FIG. 12 is a cross-sectional view of a dielectric filter which represents a sixth embodiment of the present invention.
Figure 13:
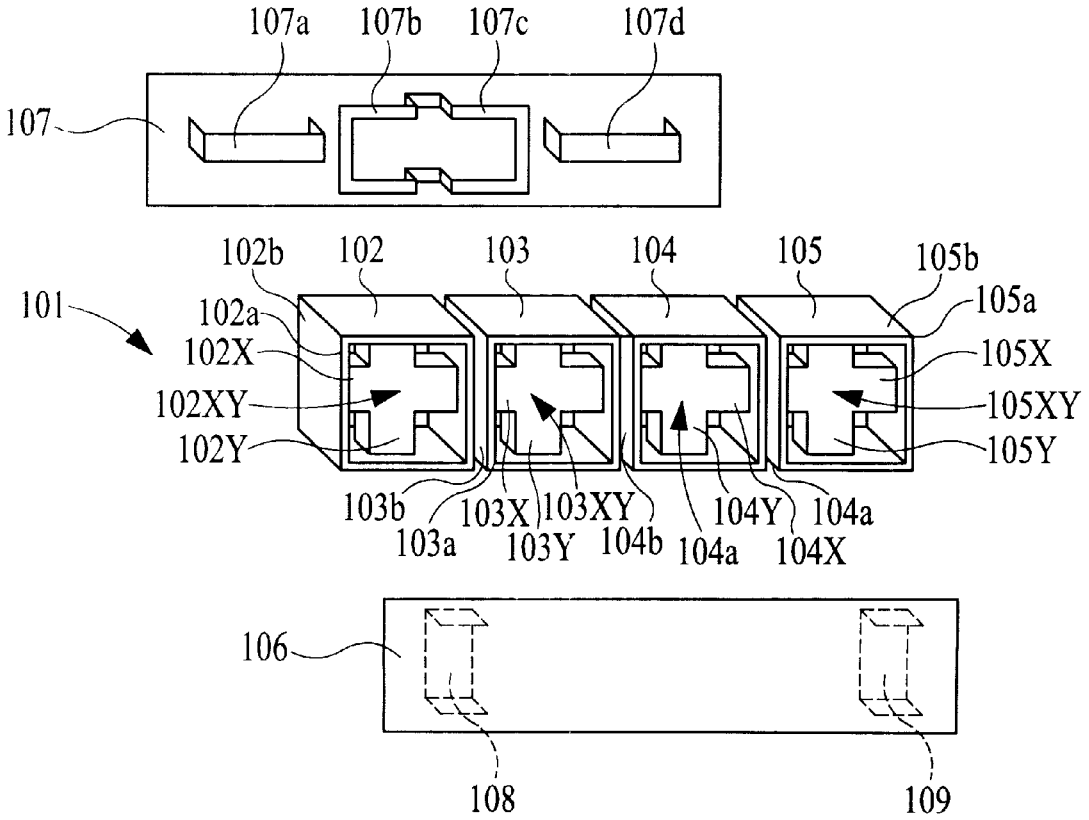
FIG. 13 PRIOR ART
FIG. 13 is an exploded perspective view of a conventional TM mode dielectric filter.

A dielectric filter 81 shown in FIG. 12 differs from the dielectric filter 1 shown in FIG. 1 in the structure of electrodes formed on the dielectric block. That is, while each of the electrodes 3 and 4 of the dielectric block 2 in the dielectric filter 1 shown in FIG. 1 is formed of a single-layer conductor, each of the electrodes 83 and 84 of a dielectric block 82 in the dielectric filter 81 shown in FIG. 12 is formed of a thin-film multilayer electrode, formed by alternately laminating a thin-film conductor and a thin-film dielectric. Such a thin-film multilayer electrode, e.g., one described in Japanese Patent Application No. 310900/1994, can be used with a reduced insertion loss in comparison with a single-layer conductor. Therefore, if such a thin-film multilayer electrode is used in a resonator, the resonator can have a higher unloaded Q.

An arrangement using a thin-film multilayer electrode in the dielectric filter shown in FIG. 1 has been described as the sixth embodiment by way of example. Needless to say, such a thin-film multilayer electrode can also be applied to each of the dielectric filters of the second to fourth embodiments and the dielectric duplexer of the fifth embodiment to obtain a dielectric filter or dielectric duplexer having a higher unloaded Q.

According to the present invention, substantially no real current flows in the shielded cavity casing which accommodates the dielectric block, so there is substantially no loss in the shielded cavity casing. As a result, a dielectric resonator, a dielectric filter and a dielectric duplexer each having a high unloaded Q can be obtained.

According to the second aspect of the present invention, a plurality of dielectric blocks are disposed in a space where an electromagnetic field distribution is generated, thereby making it possible to obtain a dielectric resonator, a dielectric filter and a dielectric duplexer each having a higher unloaded Q.

According to the third aspect of the present invention, a plurality of dielectric blocks are arranged in the direction of height while being spaced apart from each other to form a multi-stage resonator, thereby achieving a reduction in bottom surface area.

According to the fourth aspect of the present invention, a thin-film multilayer electrode is used to obtain a dielectric resonator, a dielectric filter and a dielectric duplexer each having a much higher unloaded Q.

According to the fifth aspect of the present invention, the dielectric block is formed into a cylindrical shape such that the edge of the electrode surface is at a constant distance from the center of the surface, thereby preventing occurrence of a potential difference and, hence, a current at the edge. The loss in the electrode can be further reduced thereby. As a result, a dielectric resonator having a higher unloaded Q can be obtained.

According to the ninth aspect of the present invention, an electrode sheet formed of a dielectric sheet and an electrode formed on one surface of the dielectric sheet is used coupling, and the desired degree of coupling can easily be achieved by suitably selecting the dielectric constant of the dielectric and the size of the electrode sheet.

According to the tenth aspect of the present invention, the respective resonant frequencies of the initial-stage and final-stage TM mode dielectric resonators in the state of operating alone are increased, thereby equalizing the resonant frequencies of the TM mode dielectric resonators when the resonators form a dielectric filter and are connected to an external circuit.

According to the eleventh aspect of the present invention, a plurality of TM mode dielectric filters as described above are combined to form a first TM mode dielectric filter having a first frequency band, and a second TM mode dielectric filter having a second frequency band, and the first frequency band and the second frequency band are made different from each other, thereby obtaining a dielectric duplexer having a higher unloaded Q.

According to the twelfth aspect of the present invention, the shape of the TM mode dielectric resonator forming the first TM mode dielectric filter and the shape of the TM mode dielectric resonator forming the second TM mode dielectric filter are made different from each other to make the first frequency band and the second frequency band different from each other. A need for adding a circuit for relatively shifting the frequency bands is thereby eliminated, while such a circuit is required when of using TM mode dielectric resonators having the same shape.

What is claimed is:

1. A transverse magnetic mode dielectric resonator comprising:

a shielded-cavity casing having electrical conductivity; and at least a first dielectric block disposed in said shielded-cavity casing, wherein electrodes are formed on two surfaces of said dielectric block opposite from each other, and one of the two surfaces on which the electrodes are formed is placed on an inner surface of said shielded-cavity casing;

wherein a plurality of dielectric blocks including said first dielectric block are superposed one on another so that respective electrodes formed on at least one pair of the dielectric blocks are opposed to each other while being spaced apart from each other.

2. A transverse magnetic mode dielectric resonator according to claim 1, wherein said plurality of dielectric blocks comprises three dielectric blocks, each having electrodes formed on two opposite surfaces thereof;

said pair of dielectric blocks being conductively attached to said inner surface and an opposite inner surface of said shielded-cavity casing, respectively; and said spaced-apart electrodes on said pair of dielectric blocks being conductively attached to respective ones of said opposite electrodes on a further one of said plurality of dielectric blocks.

3. A transverse magnetic mode dielectric resonator according to claim 1, wherein each of said plurality of dielectric blocks is cylindrical.

4. A transverse magnetic mode dielectric resonator according to claim 1, wherein at least one of the electrodes formed on the two surfaces of each of said dielectric blocks is formed of a thin-film multilayer electrode comprising alternately superposed thin-film conductors and thin-film dielectrics.

5. A transverse magnetic mode dielectric resonator according to claim 1, wherein said first dielectric block is cylindrical.

6. A transverse magnetic mode dielectric filter comprising:

at least one transverse magnetic mode dielectric resonator according to claim 1; and input and output connectors disposed on said casing and coupled to said at least one transverse magnetic mode dielectric resonator.

7. A transverse magnetic mode dielectric filter according to claim 6, further comprising coupling structures disposed between said at least one transverse magnetic mode dielectric resonator and said input and output connectors.

8. A transverse magnetic mode dielectric filter according to claim 7, comprising a plurality of said transverse magnetic mode dielectric resonators including said first transverse magnetic mode dielectric resonator, and further comprising coupling structures which are disposed between respective ones of the plurality of transverse magnetic mode dielectric resonators.

9. A transverse magnetic mode dielectric filter according to claim 8, wherein said coupling structures each comprise an electrode sheet formed of a dielectric sheet and an electrode formed on one surface of the dielectric sheet.

10. A dielectric filter according to claim 9, wherein said plurality of said transverse magnetic mode dielectric resonators include at least initial-stage and final-stage resonators, and wherein, in said plurality of transverse magnetic mode dielectric resonators, the respective resonant frequencies of the initial-stage and final-stage transverse magnetic mode dielectric resonators are greater than the respective resonant frequencies of the other transverse magnetic mode dielectric resonators.

11. A transverse magnetic mode dielectric filter according to claim 7, wherein said coupling structures each comprise an electrode sheet formed of a dielectric sheet and an electrode formed on one surface of the dielectric sheet.

12. A transverse magnetic mode dielectric duplexer comprising a plurality of transverse magnetic mode dielectric filters according to claim 6, said duplexer comprising:

a first transverse magnetic mode dielectric filter having a first frequency band; and a second transverse magnetic mode dielectric filter having a second frequency band, wherein the first frequency band and the second frequency band are different from each other.

13. A transverse magnetic mode dielectric duplexer according to claim 12, wherein a shape of a transverse magnetic mode dielectric resonator forming the first transverse magnetic mode dielectric filter and a shape of a transverse magnetic mode dielectric resonator forming the second transverse magnetic mode dielectric filter are made different from each other to make the first frequency band and the second frequency band different from each other.

14. A transverse magnetic mode dielectric duplexer according to claim 13, wherein the first transverse magnetic mode dielectric filter is connectable to a transmitter and to an antenna for use as a transmitting filter while the second transverse magnetic mode dielectric filter is connectable to a receiver and to said antenna for use as a receiving filter.

15. A transverse magnetic mode dielectric filter according to claim 6, wherein said plurality of dielectric blocks including said first dielectric block are superposed one on another so that said at least one pair of the dielectric blocks are adjacent to each other.

16. A transverse magnetic mode dielectric resonator according to claim 15, wherein said plurality of dielectric blocks comprises three dielectric blocks, each having electrodes formed on two opposite surfaces thereof;

said pair of dielectric blocks being conductively attached to said inner surface and an opposite inner surface of said shielded-cavity casing, respectively; and said spaced-apart electrodes on said pair of dielectric blocks being conductively attached to respective ones of said opposite electrodes on a further one of said plurality of dielectric blocks.

17. A transverse magnetic mode dielectric filter according to claim 6, wherein said plurality of dielectric blocks including said first dielectric block are superposed one on another so that respective electrodes formed on at least one adjacent pair of the dielectric blocks are in contact with each other.

* * * * *